US007296552B2

(12) United States Patent
Katayama

(10) Patent No.: US 7,296,552 B2
(45) Date of Patent: Nov. 20, 2007

(54) AIR INTAKE STRUCTURE FOR ENGINE

(75) Inventor: Goichi Katayama, Hamamatsu (JP)

(73) Assignee: Yamaha Marine Kabushiki Kaisha (JP)

( * ) Notice: Subject to any disclaimer, the term of this patent is extended or adjusted under 35 U.S.C. 154(b) by 0 days.

(21) Appl. No.: 10/814,412

(22) Filed: Mar. 31, 2004

(65) Prior Publication Data

US 2004/0187827 A1 Sep. 30, 2004

(30) Foreign Application Priority Data

Mar. 31, 2003 (JP) ..... 2003-094863

(51) Int. Cl.
*F02M 35/10* (2006.01)

(52) U.S. Cl. ..... 123/184.34

(58) Field of Classification Search ..... 123/184.21–184.61; 181/204
See application file for complete search history.

(56) References Cited

U.S. PATENT DOCUMENTS

| | | | | |
|---|---|---|---|---|
| 4,809,647 | A * | 3/1989 | Masumoto et al. | 123/184.36 |
| 4,811,697 | A * | 3/1989 | Kurahashi | 123/184.35 |
| 5,168,839 | A * | 12/1992 | Hitomi et al. | 123/184.42 |
| 5,279,267 | A | 1/1994 | Takahashi et al. | |
| 5,349,928 | A * | 9/1994 | Takahashi et al. | 123/73 A |
| 5,476,402 | A | 12/1995 | Nakai et al. | |
| 5,515,822 | A * | 5/1996 | Kobayashi et al. | 123/184.35 |
| 5,630,386 | A * | 5/1997 | Uchida | 123/184.34 |
| 5,653,202 | A * | 8/1997 | Ma | 123/184.43 |
| 5,713,771 | A | 2/1998 | Takahashi et al. | |
| 5,829,402 | A * | 11/1998 | Takahashi et al. | 123/184.24 |
| 5,941,205 | A | 8/1999 | Hiraoka et al. | |
| 6,109,231 | A | 8/2000 | Watanabe et al. | |
| 6,142,842 | A | 11/2000 | Watanabe et al. | |
| 6,298,815 | B1 | 10/2001 | Kashima et al. | |
| 6,321,720 | B1 | 11/2001 | Kashima | |
| 6,346,018 | B1 | 2/2002 | Watanabe | |
| 6,450,847 | B1 | 9/2002 | Kashima et al. | |
| 6,463,902 | B1 * | 10/2002 | Curtis et al. | 123/184.21 |
| 6,516,768 | B1 * | 2/2003 | Watanabe | 123/184.36 |
| 6,588,388 | B2 | 7/2003 | Watanabe et al. | |
| 6,736,100 | B2 * | 5/2004 | Katayama | 123/184.21 |

FOREIGN PATENT DOCUMENTS

| | | |
|---|---|---|
| JP | 07-077059 | 3/1995 |
| JP | 09-042088 | 2/1997 |
| JP | 09-189233 | 7/1997 |
| JP | 09-324653 | 12/1997 |
| JP | 10-002230 | 1/1998 |
| JP | 10-061446 | 3/1998 |
| JP | 10-297590 | 11/1998 |
| JP | 2003-182674 | 7/2003 |

* cited by examiner

*Primary Examiner*—Marguerite McMahon
(74) *Attorney, Agent, or Firm*—Knobbe, Martens, Olson & Bear, LLP

(57) ABSTRACT

An air intake system for an engine of an outboard motor includes an air intake support member that provides support for other components of the air intake system. The other component of the air intake system that can be supported by the air intake support member include a throttle valve assembly, plenum chambers, and air intake passages. The air intake passages can be made longer to increase engine performance and can be manufactured with less material because the air intake passages do not need to provide support for the air intake system.

29 Claims, 10 Drawing Sheets

AIR INTAKE STRUCTURE FOR ENGINE

PRIORITY INFORMATION

This application is based on and claims priority to Japanese Patent Application No. 2003-094863, filed Mar. 31, 2003, the entire contents of which is hereby expressly incorporated by reference.

1. Field of the Invention

The present invention relates generally to an air intake system for an engine and, more particularly, to an improved air intake system that increases engine performance and that uses an improved air intake support member.

2. Description of the Related Art

Watercraft engines typically incorporate an air intake system. Watercraft engines are designed to operate and perform well in a confined environment. The air intake system of a watercraft engine includes a throttle body housing that is usually attached to one end of the intake runners or conduits. The other end of the intake runners is attached to a body of the engine. The length of the intake runners can enhance engine performance throughout various engine speeds.

It is common practice for the intake runners of a compact watercraft engine to be supported on one of their ends by the engine body. The other end of each intake runner commonly supports the throttle body housing. The intake runners thus need to be strong enough to support the throttle body and therefore the intake runners commonly are bulky to provide the necessary rigidity and strength. Unfortunately, due to the compact area in which a watercraft engine is positioned and the fact that the throttle bodies are supported by the runners, it is difficult to benefit from longer runners.

Therefore, a need exists for an improved air intake system that incorporates intake runners that can be long enough to increase engine performance while maintaining a compact size of the engine.

SUMMARY OF THE INVENTION

One aspect of the present invention is an engine comprising an engine body and an air intake system. The engine body includes at least one combustion chamber to which the air intake system supplies air through an induction air passage. The air intake system includes an air silencer having an air intake port and a throttle body in communication with the air silencer. An induction air support member is connected to and provides fluid communication between the air silencer and the induction air passage. The induction air support member is attached to the engine body and supports at least the throttle body on the engine body.

Another aspect of the present invention involves an engine comprising an engine body that includes at least one combustion chamber and an air induction system for supplying air to the combustion chamber. The air induction system includes a support member defining at least one flow passage and a flow control device supported by the support member. The flow control device communicates with the flow passage so as to regulate an amount of air flow through the flow passage. A runner communicates with the combustion chamber and with the flow passage of the support member. One end of the runner is supported by the support member and the other end of the runner is supported by the engine body.

BRIEF DESCRIPTION OF THE DRAWINGS

The foregoing features, aspects, and advantages of the present invention will now be described with reference to the drawings of a preferred embodiment that is intended to illustrate and not to limit the invention. The drawings comprise twelve figures in which.

DETAILED DESCRIPTION OF THE PREFERRED EMBODIMENT

Figure 1:
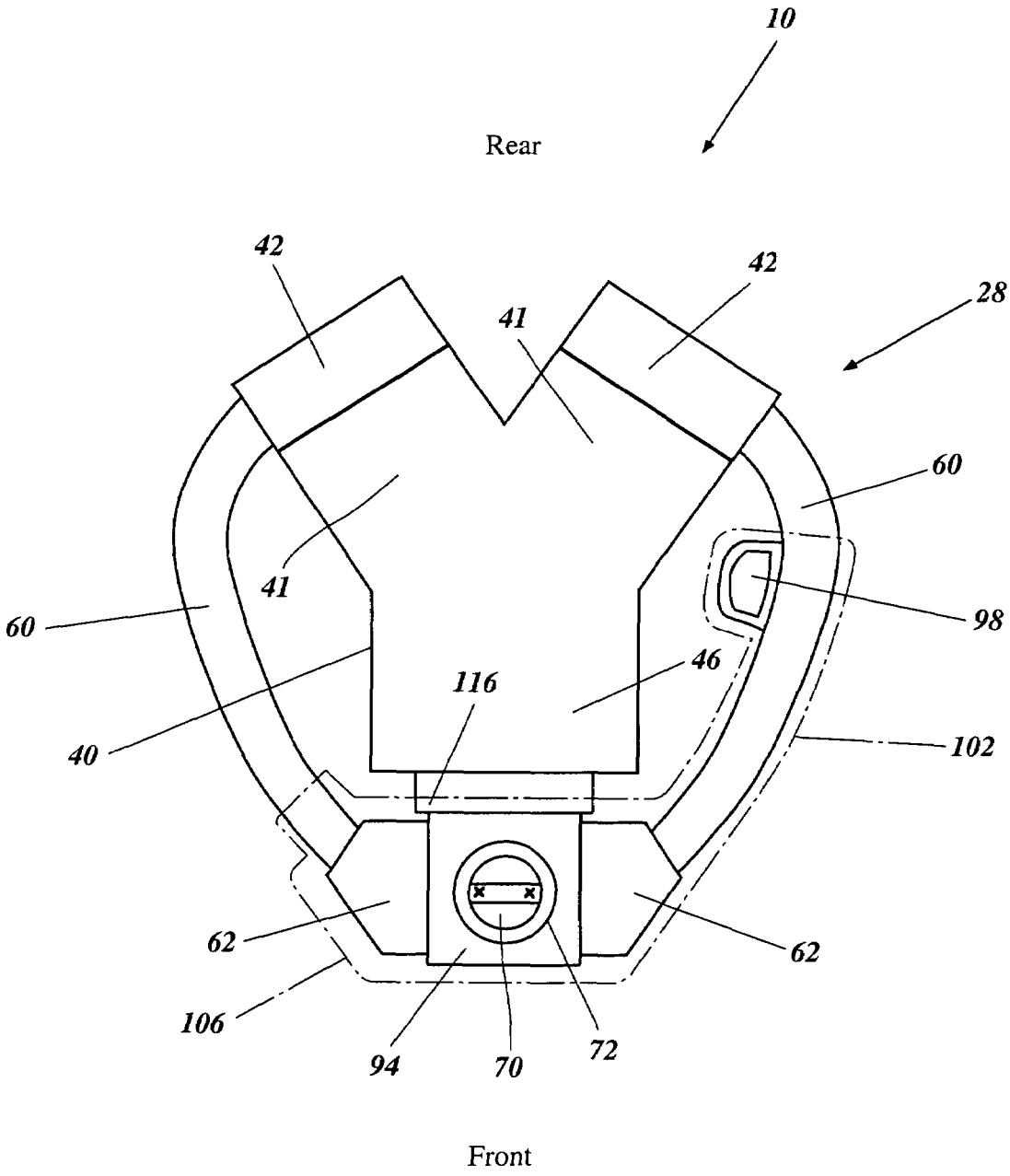
FIG. 1 is a top plan schematic view of an engine including an air intake system of an outboard motor configured in accordance with a preferred embodiment of the present invention.
Figure 2:
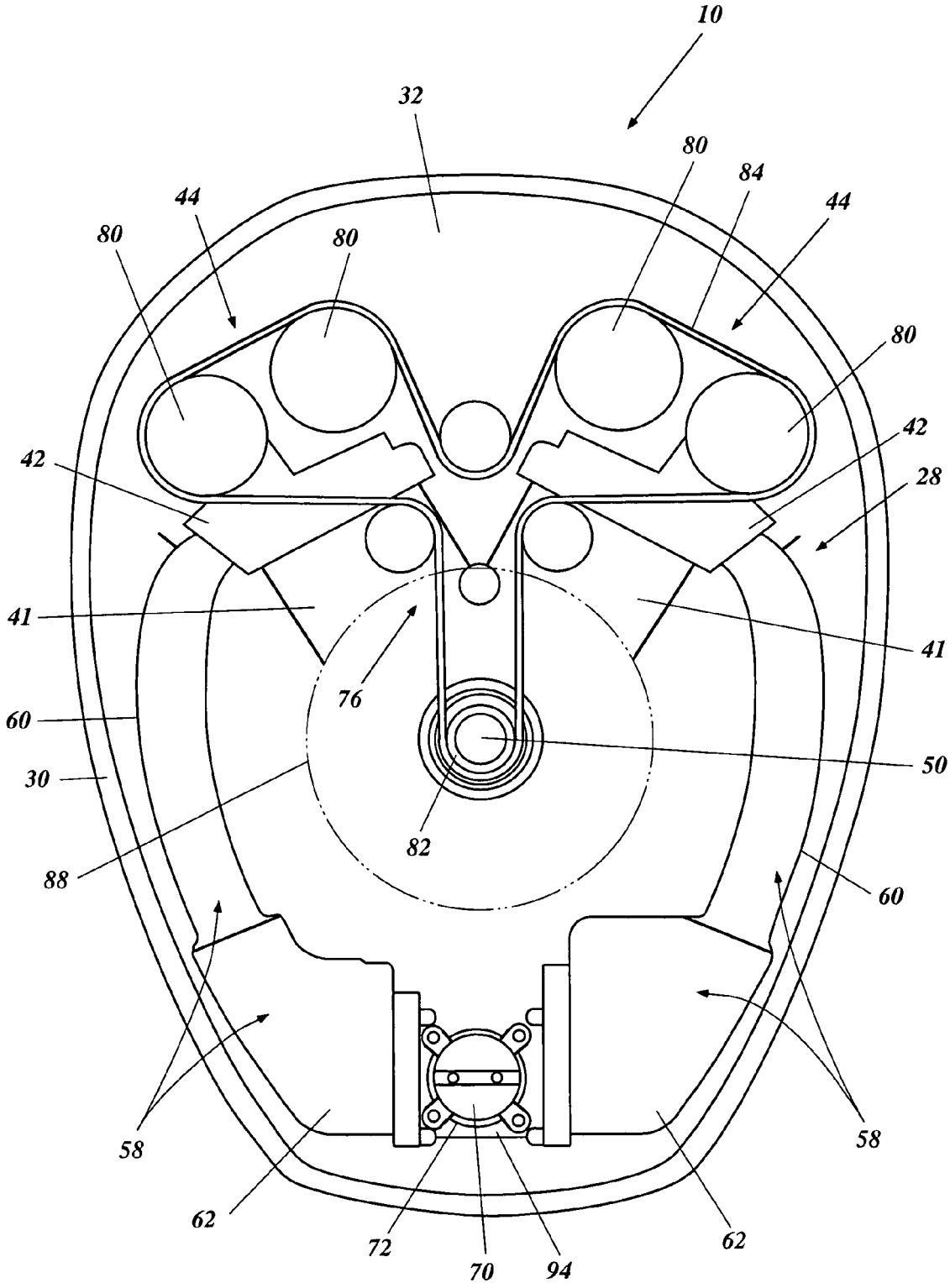
FIG. 2 is a top plan view of the engine of FIG. 1 and illustrates the air intake system as well as a camshaft drive mechanism, that is also configured in accordance with a preferred embodiment of the present invention.
Figure 3:
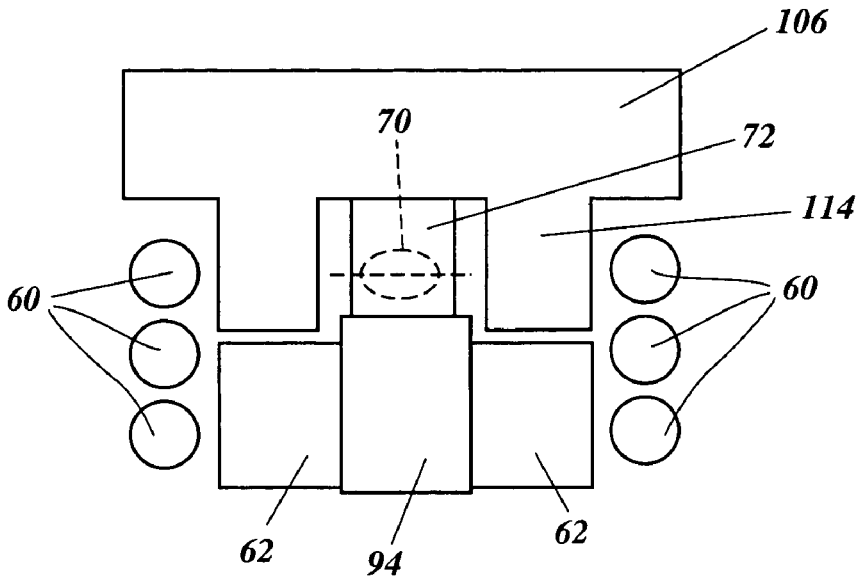
FIG. 3 is a schematic view of a front side of the air intake system of FIG. 1, which includes six individual intake passages defined at least in part by six intake runners (shown in cross-section), plenum chambers, and a throttle shown in phantom.
Figure 4:
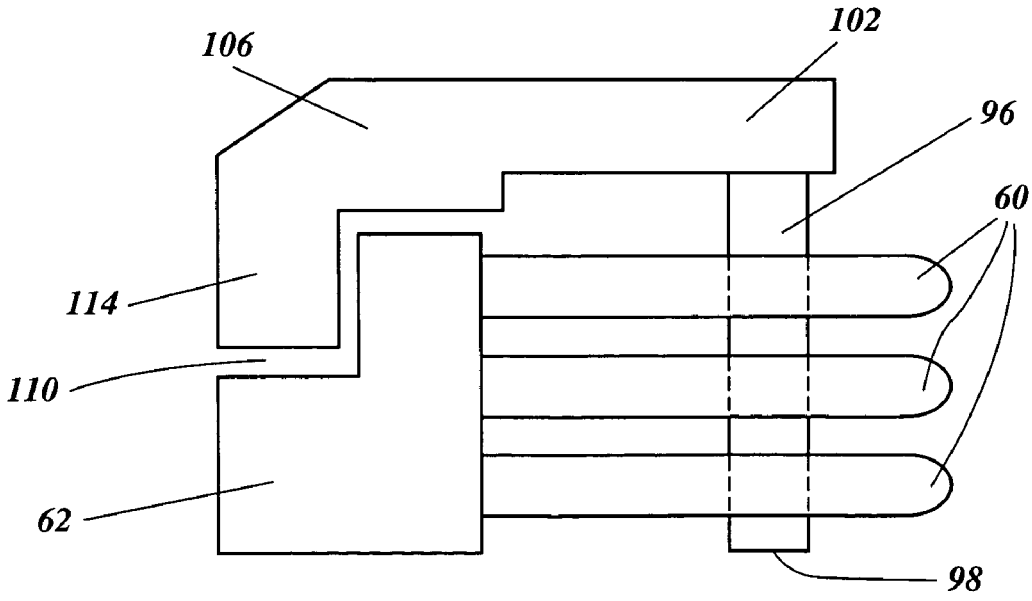
FIG. 4 is a schematic view of a right side (starboard side) of the air intake system of FIG. 3, showing three of the individual intake runners, one plenum chamber, and an intake silencer.

With reference to FIGS. 1 and 2, a top plan view of an outboard motor 10 is illustrated. As is well understood in the art, the outboard motor 10 can include a drive unit and a bracket assembly. The bracket assembly is used to attach the drive unit to an associated watercraft and supports a marine propulsion device, such as, for example, a propeller in a submerged position relative to a surface of a body of water.

As used herein, the terms "forward," "forwardly," and "front" mean at or to the side labeled "FRONT" in FIG. 1, and the terms "rear," "reverse," "backward," and "rearward" mean at or to the side labeled "REAR" in FIG. 1, unless indicated otherwise or otherwise readily apparent from the context used. Additionally, the term "horizontally" means that members or components extend generally parallel to the water surface (i.e., generally normal to the direction of gravity) when the outboard motor is positioned in a generally "neutral" trim position (i.e., neither trimmed in or out); a rotational axis of the propulsion device lies generally parallel to the water surface when the outboard motor assumes the neutral trim position. The term "vertically" in turn means that proportions, members or components extend generally normal to those that extend horizontally.

An internal combustion engine 28 is located within a protective cowling assembly 30. The protective cowling assembly 30 typically defines a generally closed cavity 32 in which the engine 28 is disposed. The engine 28 is thereby is generally protected by the cowling assembly 30 from environmental elements.

The engine 28 in the illustrated embodiment preferably operates on a four-cycle combustion principle. With continued reference now FIGS. 1 and 2, the engine illustrated is a DOHC (double overhead cam) six-cylinder engine having a V-shaped cylinder block 40. The cylinder block 40 thus defines two cylinder banks 41, which lie generally next to each other. In the illustrated arrangement, each cylinder bank 41 has three cylinder bores such that the cylinder block 40 has six cylinder bores in total. The cylinder bores of each bank extend generally horizontally and are generally vertically spaced apart from one another. This type of engine, however, merely exemplifies one type of engine. Engines having other numbers of cylinders, having other cylinder arrangements (in line, opposing, etc.), and operating on other combustion principles (e.g., two-stroke or rotary) can be used in other embodiments.

A movable member, such as a reciprocating piston (not shown), moves relative to the cylinder block 40 in a suitable manner. In the illustrated arrangement, the piston reciprocates within each cylinder bore. Because the cylinder block 40 is split into the two cylinder banks 41, each cylinder bank 41 extends outward at an angle and terminates at on outer end of the bank 41. A pair of cylinder head members 42 are fixed to the respective outer ends of the cylinder banks to close those ends of the cylinder bores. The cylinder head members 42 together with the associated pistons and cylinder bores provide six combustion chambers (not shown). Of course, the number of combustion chambers can vary. Each of the cylinder head members 42 is covered by a cylinder head cover member 44. In some arrangements, the cylinder head cover members 44 can be unitarily formed with the respective cylinder members 42.

A crankcase member 46 is coupled with the cylinder block 40 on the front side of the cylinder block 40 and a crankcase cover (not shown) is further coupled with a crankcase member 46. The crankcase member 46 and a crankcase cover close the other end of the cylinder bores and, together with the cylinder block 40, define a crankcase chamber. A crankshaft 50 extends generally vertically through the crankcase chamber and is journaled for rotation about a rotational axis by several bearing blocks. Connecting rods couple the crankshaft 50 with the respective pistons in any suitable manner. Thus, reciprocal movement of the pistons rotates the crankshaft 50. In some arrangements, the crankcase cover member can be unitarily formed with the crankcase member 46. Thus, the cylinder heads, cylinder block and crankcase member together define at least a portion of a body of the engine.

As mentioned above, a driveshaft housing preferably supports a driveshaft, which is coupled with crankshaft 50 and which extends generally vertically through driveshaft housing. The driveshaft is journaled for rotation and is driven by the crankshaft 50 via a suitable coupling (preferably a direct coupling).

A lower unit (not shown) depends from the driveshaft housing and supports a propulsion shaft (not shown) that is driven by the driveshaft. A propulsion device is attached to the propulsion shaft. The propulsion device can take the form of a single propeller, a dual counter-rotating propeller system, a hydrodynamic jet, or any of a number of other suitable propulsion devices.

The engine 28 also comprises an air intake system 58. The air intake system 58 draws air from outside the engine, preferably from within the closed cavity 32 or an air passage within the cavity 32, to the combustion chambers. The illustrated air intake system 58 comprises six intake passages defined at least in principal part by intake runners or conduits 60 and a pair of plenum chambers 62. In the illustrated arrangement, each cylinder bank communicates with three intake passages 60 and one plenum chamber 62.

The most downstream portions of the intake passages 60 are defined within the cylinder head member 42 as inner intake passages (not shown). The inner intake passages communicate with the combustion chambers through intake ports, which are formed at inner surfaces of the cylinder head members 42. Typically, each of the combustion chambers has one or more intake ports. Intake valves are disposed at each cylinder head member 42 to move between an open position and a closed position.

The intake valves act to open and close the ports to control the flow of air into the combustion chamber. Biasing members, such as springs, are used to urge the intake valves toward their respective closed positions by acting between a mounting boss formed on each cylinder head member 42 and a corresponding retainer that is affixed to each of the valves. When each intake valve is in the open position, the inner intake passage thus associated with the intake port communicates with the associated combustion chamber. Of course, other types of valve actuating mechanisms (e.g., hydraulic or electric) can be used to control the amount and timing of air flow into the combustion chambers.

The air within the closed cavity 32 is drawn into the plenum chamber 62. The air expands within the plenum chamber 62 to reduce pulsations and then enters the intake runners 60. The air passes through the intake runner 60 and flows into the inner intake passages located in each cylinder head member 42. A throttle valve 70 mounted inside a throttle valve assembly 72 regulates the amount of airflow allowed to enter the plenum chamber 62 and ultimately into the intake passages 60; however, other types of flow control devices can be used as well to regulate air flow to the engine. These and other components of the air intake system 58 will be described in detail below.

The engine 28 further includes an exhaust system that routes burnt charges, i.e., exhaust gases, to a location outside of the outboard motor 10. Each cylinder head member 42 defines exhaust passages (not shown) that communicate with the combustion chambers through one or more exhaust ports, which can be defined at the inner surfaces of the respective cylinder head members 42. The exhaust ports can be selectively opened and closed by exhaust valves. The construction of each exhaust valve and the arrangement of the exhaust valves are substantially the same as the intake valve and the arrangement thereof, respectively. Thus, further description of these components is deemed unnecessary. Additionally, the valve actuation mechanism used to control the timing and duration of exhaust valve movement preferably is of the same type used to actuate the intake valves.

Exhaust manifolds preferably are defined generally vertically with the cylinder block 40 between the cylinder bores of both the cylinder banks 41. The exhaust manifolds communicate with the combustion chambers through the inner exhaust passages and the exhaust ports to collect the exhaust gas therefrom. The exhaust manifolds are coupled with an exhaust discharge passage (not shown). When the exhaust ports are opened, the combustion chambers communicate with the exhaust discharge passage through the exhaust manifolds.

In the illustrated embodiment, a valve cam mechanism preferably is provided for actuating the intake and exhaust valves in each cylinder bank. In the embodiment shown, the valve cam mechanism includes second rotatable members such as a pair of camshafts disposed in the cylinder head 42 of each cylinder bank 41. The camshafts typically comprise intake and exhaust camshafts that extend generally vertically and are journaled for rotation generally between the cylinder head members 42 and the cylinder head cover members 44. The camshafts have cam lobes (not shown) to push the respective ends of the intake and exhaust valves in any suitable manner. The cam lobes repeatedly push the valves in a timely manner in proportion to the engine speed. The engine can also include a variable valve timing mechanism. In one form of such a mechanism, a hydraulic actuator can cooperate with one or more of the cam shafts to adjust valve timing, as well known in the art.

The camshaft drive mechanism 76 preferably is provided for driving the valve cam mechanism. The camshaft drive mechanism 76 is illustrated in FIG. 2 and includes driven sprockets 80 positioned atop at least one of each pair of camshafts, a drive sprocket 82 positioned atop the crankshaft 50 and a flexible transmitter, such as a timing belt or chain 84. The flexible transmitter is wound around the driven sprockets 80 and the drive sprocket 82. The crankshaft 50 thus drives the respective camshaft through the time belt 84 in the timed relationship.

The illustrated engine 28 can further include indirect, port or intake passage fuel injection, or the engine can also be carbureted. The fuel injection system (not shown) can include at least six fuel injectors with at least one fuel injector allotted to each one of the respective combustion chambers. In one form, the fuel injectors can spray fuel into the intake passages 60 under control of an electronic control unit (ECU, not shown). The ECU controls the initiation and duration of the fuel injection cycle of each fuel injector so that the fuel injectors spray a desired amount of fuel for each combustion cycle.

The engine 28 further includes an ignition system. Each combustion chamber is provided with a spark plug (not shown) or another type of igniter, preferably disposed between the intake and exhaust valves. The spark plugs generate a spark between electrodes to ignite an air/fuel charge in the combustion chamber according to desired ignition timing maps or other forms of controls.

Generally, during an intake stroke, air is drawn into the combustion chambers through the air intake passages 60 and fuel is sprayed into the air by the fuel injectors. The mixture is then compressed during the compression stroke. Just prior to a power stroke, the respective spark plugs ignite the compressed air/fuel charge in the respective combustion chambers. The air/fuel charge thus rapidly burns during the power stroke to move the pistons. The burnt charge, i.e., exhaust gases, then is discharged from the combustion chambers during an exhaust stroke.

The illustrated engine further comprises a lubrication system to lubricate the moving parts within the engine 28. The lubrication system is a pressure fed system where the correct pressure is important to adequately lubricate the bearings and other rotating surfaces.

The flywheel assembly 88, which is schematically illustrated with phantom line in FIG. 2, preferably is positioned atop the crankshaft 50 and is positioned for rotation with the crankshaft 50. The flywheel assembly 88 advantageously includes a flywheel magneto that supplies electric power directly or indirectly via a battery to various electrical components, such as to the fuel injection system, the ignition system and the ECU.

The engine 28 may include other systems, mechanisms, devices, accessories, and components other than those described above such as, for example, a cooling system and a starter motor. The crankshaft 50 can directly or indirectly drive at least some of those systems, mechanisms, devices, accessories, and components. For example, the crankshaft can drive a water pump of an open-loop cooling system via the driveshaft, as well known in the art.

The air intake system 58 will now be described in greater detail. As seen in FIGS. 1 and 2, the air intake system 58 includes an air intake support member 94 that supports the plenum chambers 62, the corresponding intake runners 60, and the throttle valve assembly 72.

Figure 6:
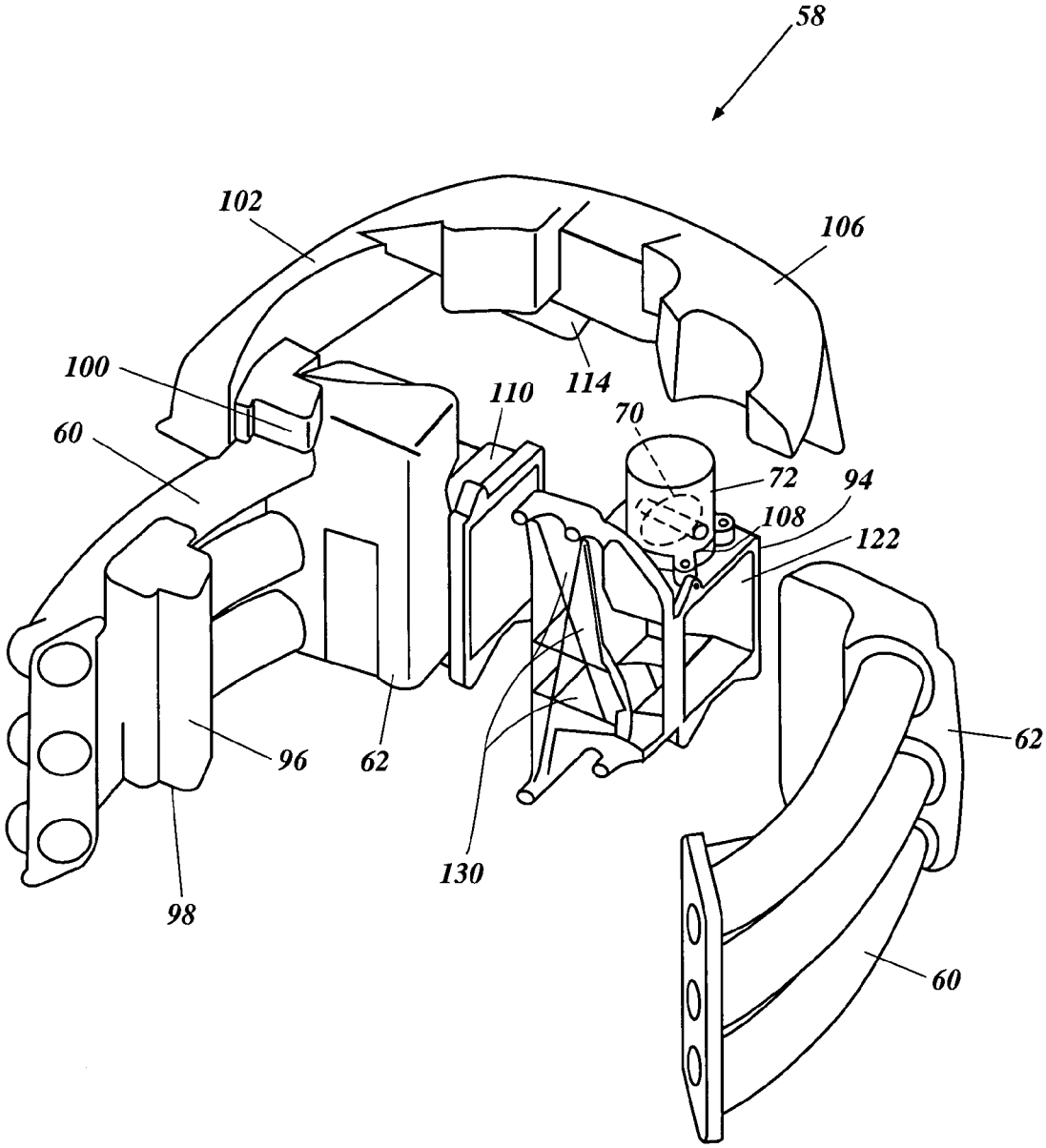
FIG. 6 is an exploded rear perspective view of the air intake system of FIG. 3 showing two plenum chamber housings, the intake silencer, a throttle housing, and the air intake support member.

In the illustrated embodiment, which is best seen with reference to FIGS. 1, 3, 4 and 6, air enters the air intake system 58 through an intake opening 98 of an intake channel 96. The intake opening 98 is disposed near the bottom of the engine 28 in the illustrated embodiment. The intake channel 96 is connected to a protruding member 100 (which is seen in FIG. 6) that communicates with and can be formed with a side portion 102 of an intake silencer 106. The intake silencer 106 guides the inducted air to the throttle valve assembly 72 where the throttle valve 70 regulates the amount of air flowing through the throttle valve assembly 72. Heat from the engine, which rises to the top of the protective cowling 30, allows for cooler, denser air to be drawn into the air intake system. The inducted intake air is guided into an air intake support member 94 after passing through the throttle valve assembly 72. The air flows from the air intake support member 94 to each plenum chamber 62. Pulsations from the inducted air are reduced in the plenum chambers 62 and the air flows into the respective intake air passages 60. While the illustrated embodiment employs one intake silencer 106 and one intake opening 98, a plurality of intake silencers and/or a plurality of intake openings can be used with the present induction system.

As best understood from FIGS. 6, 7, 9 and 10, the throttle valve assembly 72 is mounted to the air intake support member 94 through a throttle mounting seat 108. Preferably, the throttle valve 70 is a butterfly valve that has a valve shaft journaled for pivotal movement about generally horizontal axis. A control linkage is connected to an operational member, such as a throttle lever, that is provided on the watercraft or otherwise proximate the operator of the watercraft. The operator can control the opening degree of the throttle valve in accordance with operator request through the control linkage. That is, the throttle valve assembly 72 can measure or regulate amounts of air that flow through intake passages 60 through the combustion chambers in response to the operation of the operational member by the operator. Normally, the greater the opening degree, the higher the rate of air-flow and the higher the engine speed. While the illustrated embodiment employs only a single throttle valve, the intake system can use a plurality of throttle valves that operate in parallel to regulate air flow into the plenum chambers. The chambers, in this arrangement, can be isolated from each other or can communicate with each other (such as, for example, via the intake support member) to balance air pressure.

Figure 7:
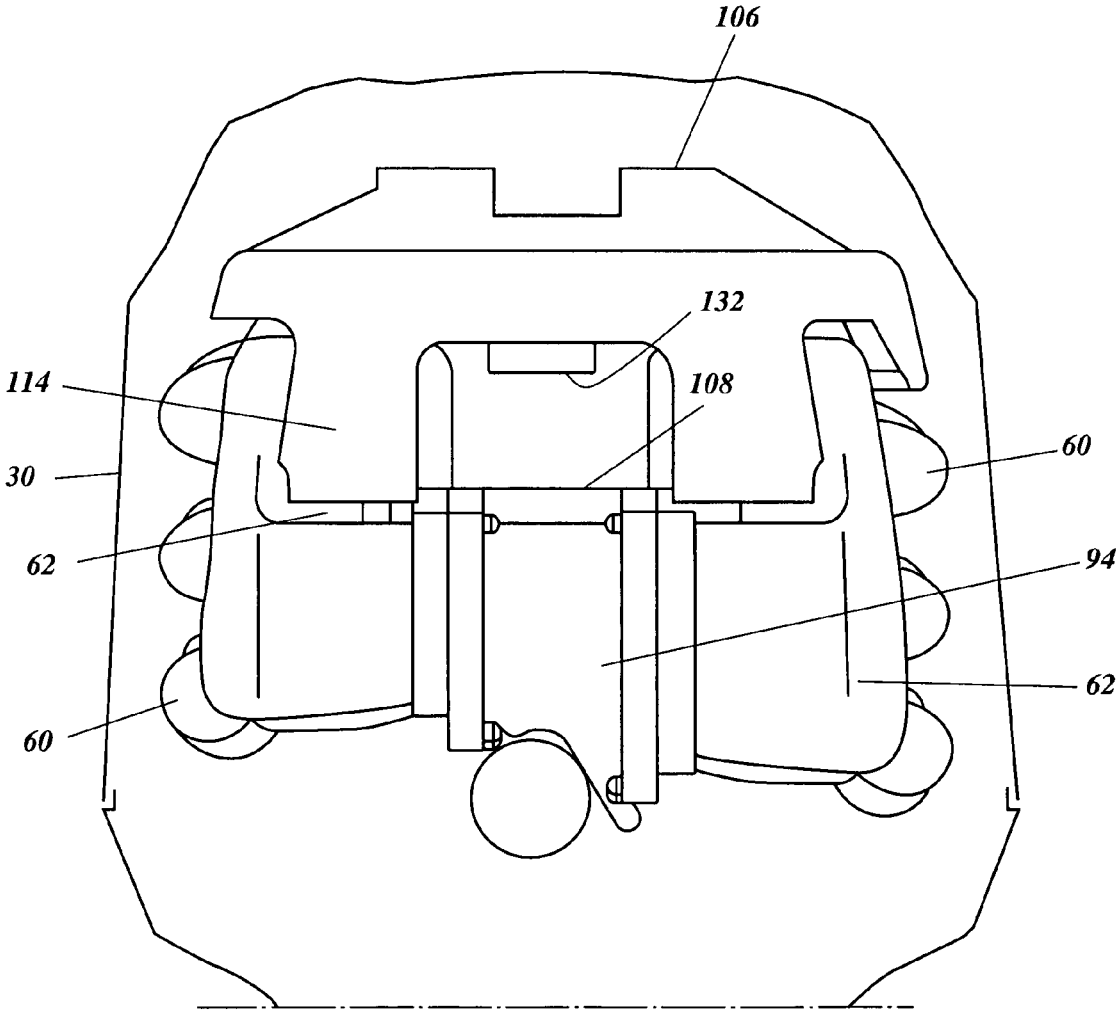
FIG. 7 is a front side elevational view of the front of the engine of FIG. 2, with various pieces of the air intake system shown assembled.
Figure 8:
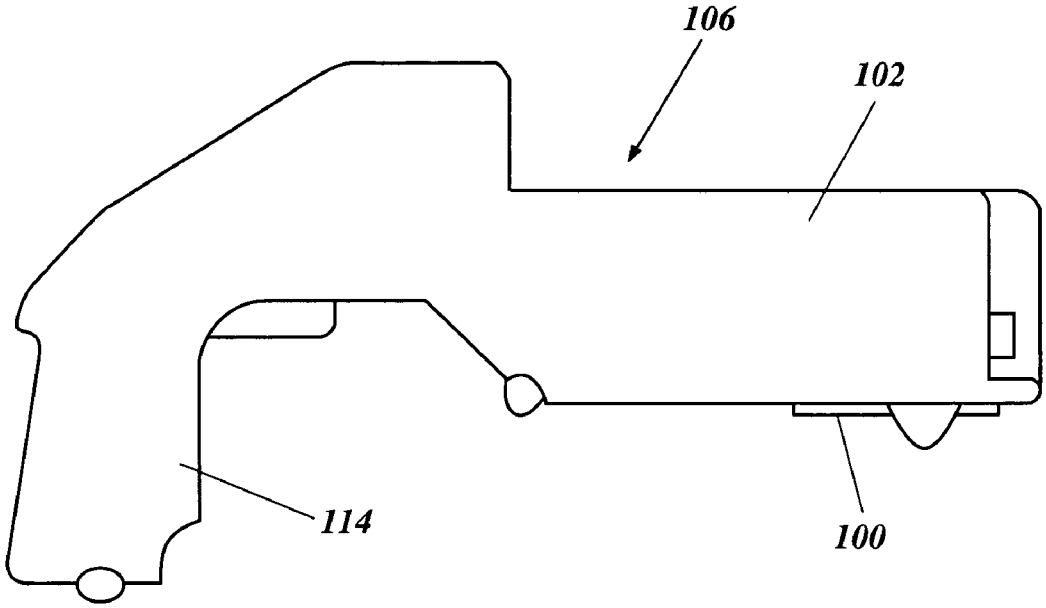
FIG. 8 is right side elevational view of the intake silencer of the air intake system shown in FIG. 6.
Figure 9:
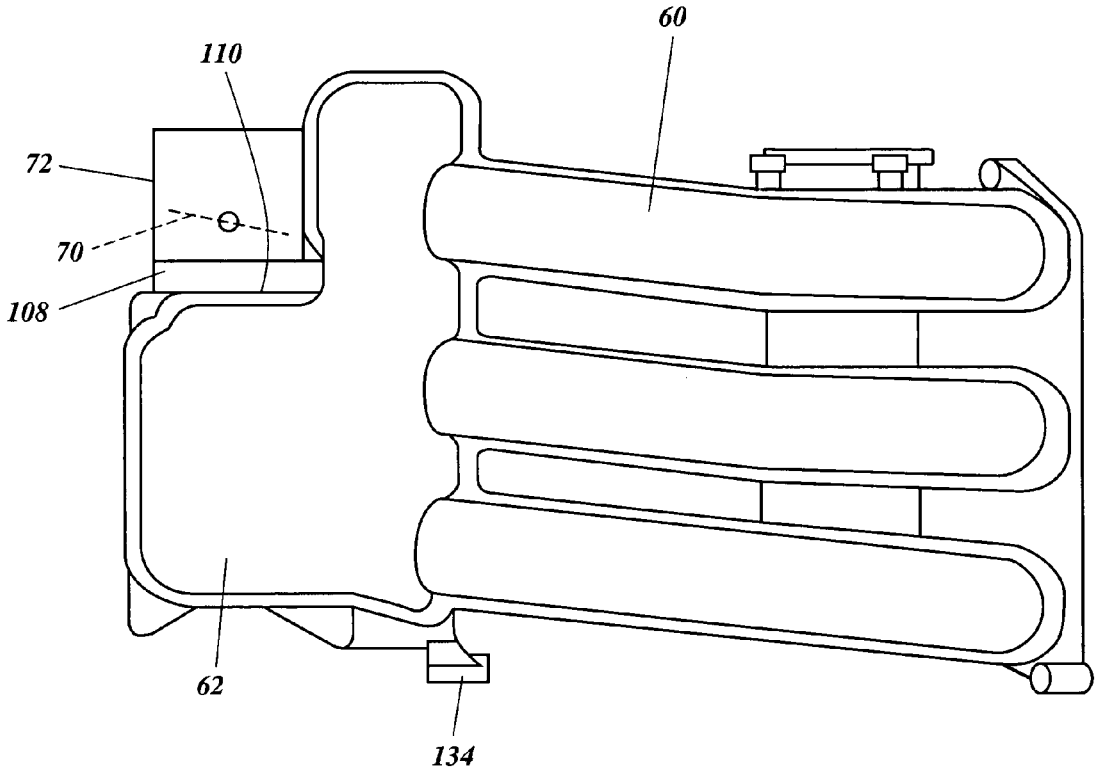
FIG. 9 is a right side elevational view of the right plenum chamber housing of FIG. 6, with the three right side intake runners and the throttle housing shown.
Figure 10:
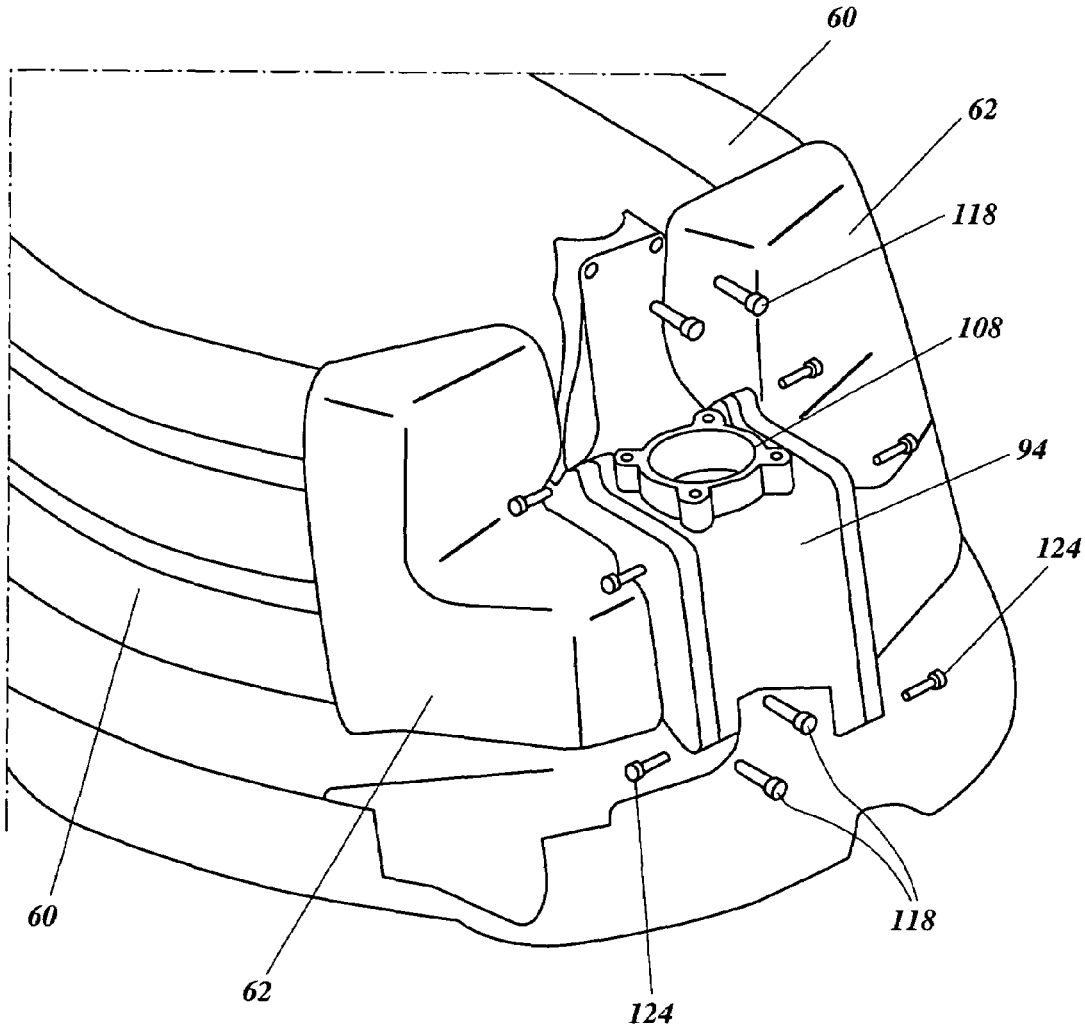
FIG. 10 is front perspective view of the air intake system of FIG. 6.

As seen in FIGS. 6, 9, and 10, recesses 110 are formed in each plenum chamber 62 to allow sufficient space to mount each plenum chamber 62 to the intake support member 94. The intake silencer incorporates protrusions 114 (as seen in FIGS. 6 through 8) to take advantage of the spaces formed by the recesses 110 allowing improved intake air noise reduction and efficient use of space in the compact closed cavity 32.

The respective intake runners 60 extend forwardly along side surfaces of the engine 28 on both the port side and the starboard side from the respective cylinder head members 42. In the illustrated embodiment, the intake runners 60 terminate generally at the front of the crankcase 46. The intake runners 60 on the same side extend generally parallel to each other and are vertically spaced apart from one another.

The respective plenum chambers 62 are connected with each other through the air intake support member 94 which substantially equalizes the internal pressures within each chamber 62. The plenum chambers 62 coordinate or smooth air delivered to each intake passage 60 and also act as silencers to reduce intake noise.

Figure 5:
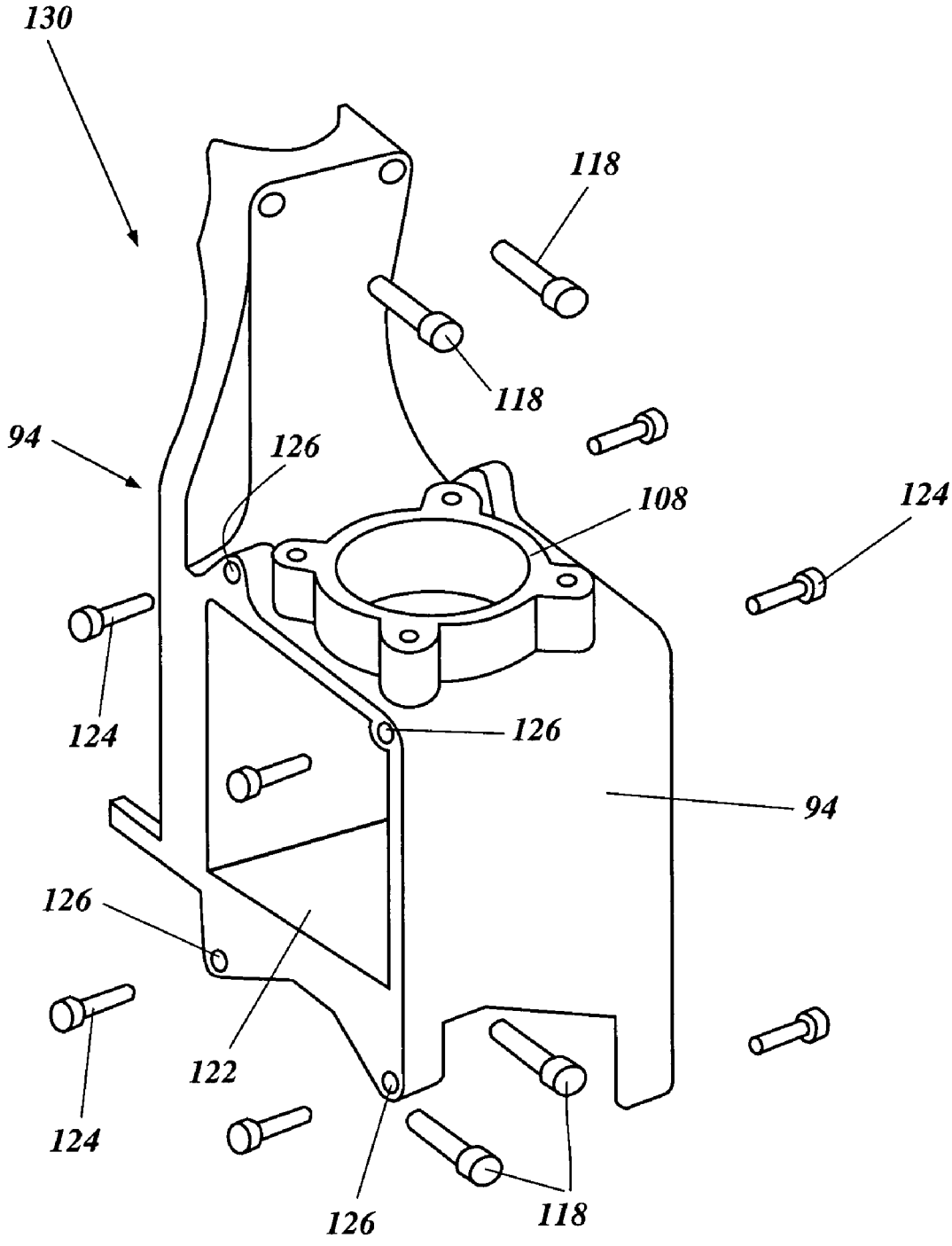
FIG. 5 is a perspective view of an air intake support member of the air intake system of FIG. 3, with various mounting bolts shown.

With reference to FIG. 5, the air intake support member 94 is advantageously mounted to a mounting member 116 (FIG. 1) through fasteners 118 that can be attached to the mounting member 116. In the illustrated embodiment, the fasteners 118 are bolts that thread into threaded holes (not shown) formed on the mounting member 116. Of course, other types of fasteners can also be used.

The mounting member 116 is preferably incorporated into the crankcase cover or the front portion of the engine 28. By mounting the air intake support member 94 to the mounting member 116 located on the front side portion of the engine 28, the air intake support member 94 is able to advantageously support the throttle valve assembly 72 and the air runners 60. Supporting the air runners 60 by the air intake support member 94 allows the air passages to be longer, which can improve engine performance. By having both ends of the air intake runners 60 supported on the engine, the air intake runners 60 themselves can be less rigid than in prior induction system designs, therefore using less material so that the air intake runners 60 can be made more compact and use less space. The saved space due to the compact air intake runners 60 improves the overall compact design of the engine 28 that is positioned within the compact closed cavity 32. The weight of the engine 28 is also reduced.

The air intake support member 94 includes a support member cavity or flow passage 122 that allows fluid communication between each air intake passage 60 and the throttle valve 70. The communication between the plenum chambers 62 allows intake pulsations between each plenum chamber 62 to increase the volumetric efficiency of the engine, which can lead to an increase in engine performance and to generally smooth engine operation. Each plenum chamber 62 is mounted to the air intake support member 94 through fasteners 124 that can be attached to the air intake support member 94. The fasteners 124 preferably are bolts that thread into threaded holes 126 located in the air intake support member 94; however, other types of fasteners can also be used.

FIG. 6 illustrates an exploded perspective view of the air intake system 58 including the air intake runners 60, the plenum chambers 62, the intake silencer 106, the throttle valve assembly 72, and the air intake support member 94 along with other air intake system components. A molded structure system 130 is preferably incorporated into the back side of the air intake support member 94. The molded structure system 130 strengthens the air intake support member 94. The strengthening provided by the molded structure system 130 allows the air intake support member to provide enhanced support for the plenum chambers 62 and the air intake runners 60.

Each component when assembled together, as illustrated in FIG. 7, forms the compact air intake system 58 that fits inside the compact closed cavity 32. (The assembled air intake system 58 illustrated in FIG. 7 shows the air intake system 58 without the throttle valve assembly 72 to better illustrate a throttle communication port 132 that allows fluid communication between the air intake silencer 106 and the throttle valve 70.) The induction air travels from the air intake silencer 106 through the throttle communication port 132 to be regulated by the throttle 70 before entering into the air intake support member 94.

FIG. 8 illustrates the air intake silencer 106 in greater detail. The unique form of the air intake silencer 106 allows for a compact fit of the air intake silencer 106 with the other components of the air intake system 58 so as to fit advantageously within the compact closed cavity 32. The induction air enters the air intake silencer 106 through the protruding member 100 and travels through the side portion 102 through the angled structure of the air intake silencer 106 to the protrusions 114. The induction air further travels through the protrusions 114 and enters into the throttle assembly 72 that is mounted to the air intake support member 94.

FIG. 9 illustrates a side elevational view of the plenum chamber 62 and the air intake runners 60. The induction air travels from the throttle assembly 72 through the throttle 70 into the plenum chamber 62. The induction air travels from the plenum chamber 62 to the air intake runners 60 to the engine 28. An attachment boss 134 allows the plenum chamber 62 and the air intake runners 60 to be further attached and supported by the air intake support member 94.

FIG. 10 illustrates the entire air intake system 58 compactly assembled to fit inside the compact closed cavity 32. Each member of the air intake system 58 is preferably assembled to efficiently utilize all the space provided within the compact closed cavity 32 of the outboard motor 10.

Figure 11:
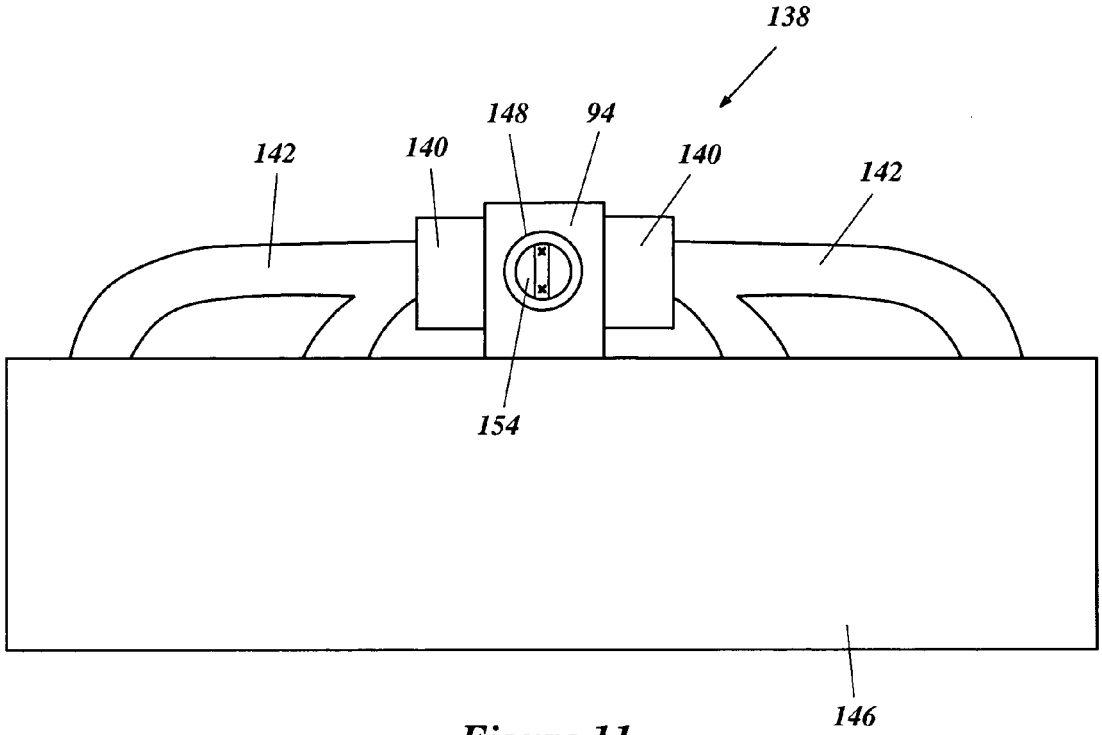
FIG. 11 is a top plan view of an air intake support member mounted on an inline engine configured in accordance with another preferred embodiment of the present invention.
Figure 12:
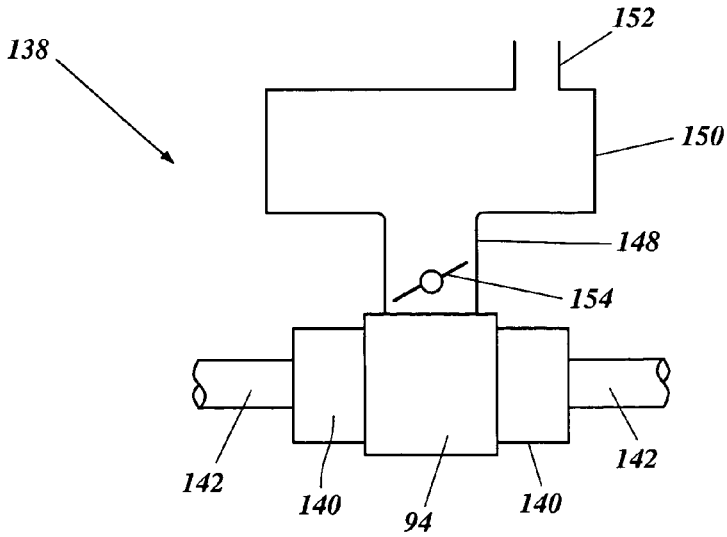
FIG. 12 is a side elevational view of the air intake support member mounted on the inline engine of FIG. 11 along with a throttle body and an intake silencer shown.

FIGS. 11 and 12 illustrate another embodiment of the present induction system. FIG. 11 illustrates another air intake system 138 that includes another form of the air intake support member 94. The air intake support member 94 is shown supporting two plenum chambers 140 and two sets of air intake runners 142 of an inline engine 146. The air intake support member 94 is able to advantageously support a throttle valve assembly 148 and the air intake runners 142. Supporting the plenum chambers 140 and air intake runners 142 by the air intake support member 94 allows the air intake runners 142 to be longer and lighter because the air intake runners 60 do not need to be designed to support the weight of the throttle valve assembly 72. The longer air intake runners 142 can allow for an increase in volumetric efficiency improving engine performance. Supporting the plenum chambers 140 and the air intake runners 142 also allow the air intake runners to be less rigid, therefore the air intake runners 142 require less space. The saved space due to the compact air intake runners 60 improves the overall compact design of the inline engine that can be positioned within a compact engine compartment.

FIG. 12 illustrates the air intake system 138 of FIG. 11 including an air intake silencer 150 that is mounted to the throttle valve assembly 148 and is positioned above the throttle valve assembly 148. Induction air enters the intake air silencer 150 through an inlet 152. The air intake support member 94 advantageously supports the plenum chambers 140, the air intake runners 142, the throttle valve assembly 148, and the intake air silencer 150 as well as guiding induction air from the throttle valve assembly 148 through a throttle valve 154 to the plenum chambers 140.

Although the present invention has been described in terms of a certain preferred embodiments, other embodiments apparent to those of ordinary skill in the art also are within the scope of this invention. Thus, various changes and modifications may be made without departing from the spirit and scope of the invention. For instance, the air intake system can be employed on engines used to propel other types of vehicles (e.g., personal watercraft, automobile, ATV and the like). Moreover, not all of the features, aspects and advantages are necessarily required to practice the present invention. Accordingly, the scope of the present invention is intended to be defined only by the claims that follow.

What is claimed is:

1. An engine for an outboard motor wherein the engine is positioned within an engine cowling, the engine comprising an engine body including a plurality of combustion chambers, a crankcase member comprising a crankshaft that is disposed to rotate about a generally vertical axis, and an air induction system for supplying air to the combustion chambers, the air induction system comprising a support member defining at least one flow passage, the support member being attached to the crankcase member, a flow control device disposed above the support member and supported by the support member, the flow control device being positioned upstream of the flow passage and communicating with the flow passage so as to regulate an amount of air flow through the flow passage, at least two runners, the runners positioned on opposite sides of the engine body from each other and being in fluid communication with at least one corresponding combustion chamber and with the flow passage of the support member, one end of each runner being supported by the support member and the other end of each runner being supported by the engine body, the flow passage being positioned to deliver air flow from the flow control device to the ends of the runners supported by the support member.

2. The engine of claim 1, wherein the runners are attached to the engine body.

3. The engine of claim 2, wherein the engine body includes a cylinder head that defines an intake passage that selectively communicates with at least one of the combustion chambers, and one of the runners is connected to the cylinder head in a manner placing the runner in fluid communication with the intake passage.

4. The engine of claim 1 additionally comprising a plenum chamber housing defining a plenum chamber and being disposed between the support member and one of the runners.

5. The engine of claim 4, wherein the plenum chamber is attached to the support member such that at least a portion of the air flow from the flow passage flows into the plenum chamber.

6. The engine of claim 5, wherein said one of the runners is attached to the plenum chamber housing.

7. The engine of claim 1 additionally comprising an air silencer arranged to supply air to the flow control device.

8. The engine of claim 7, wherein the air silencer is disposed at least in part above the crankcase member.

9. The engine of claim 7 additionally comprising an air intake conduit connected to the air silencer, the air intake conduit including an inlet that is disposed near a lower side of the engine body.

10. The engine of claim 1 additionally comprising a plurality of runners and a plurality of combustion chambers, at least one runner communicating with each combustion chamber.

11. The engine of claim 10, wherein each of the runners communicates with a plenum chamber disposed between the support member and the runners.

12. The engine of claim 11, wherein the support member supports the plenum chamber on the engine body.

13. The engine of claim 1, wherein the runners extend next to the engine body such that the engine body can be disposed within an engine cowling.

14. The engine of claim 1, wherein the flow control device includes a rotatable throttle valve.

15. The engine of claim 1, wherein the engine body comprises two cylinder banks arranged in a V-shape.

16. A marine engine positioned within an engine cowling, the engine comprising an engine body including at least one cylinder that has a cylinder axis and that defines in part a combustion chamber and a crankshaft that is positioned to rotate about a generally vertical axis, and an air intake system including an air silencer having an air intake port, a throttle body in communication with the air silencer, at least one induction air passage extending along a side of the engine body generally next to the at least one cylinder and substantially parallel with the cylinder axis, a plenum chamber housing defining a plenum chamber, the plenum chamber being positioned downstream of the throttle body, and an induction air support member, the induction air support member connected to and providing fluid communication between the air silencer and the induction air passage, the induction air support member being attached to the engine body and supporting the throttle body, wherein the throttle body is disposed above the induction air support member.

17. The engine of claim 16, wherein the induction air support member also supports, at least in part, the air silencer on the engine.

18. The engine of claim 16, wherein the induction air support member also supports at least one end of the induction air passage.

19. The engine of claim 16, further comprising a second air induction passage, the engine body being interposed between and surrounded by the air induction passages.

20. The engine of claim 16, wherein the at least one induction air passage is in communication with only one combustion chamber.

21. The engine of claim 16, wherein the air intake system comprises at least two runners positioned on opposite sides of the engine body from each other, each runner being in fluid communication with a corresponding combustion chamber of the engine, and the runners define the at least one induction air passage.

22. An engine disposed within a cowling, the engine comprising an engine body including at least one combustion chamber, a crankshaft disposed to rotate about a generally vertical axis within the engine body, and an air intake system including an air silencer having an air intake port, a throttle body in communication with the air silencer, at least two induction air passages, and an induction air support member, the induction air support member connected to and providing fluid communication between the air silencer and the induction air passages, the induction air support member being attached to the engine body and supporting the throttle body, the engine body comprising two cylinder banks arranged in a V-shape and having first and second outer sides, at least one induction air passage being positioned along the first outer side of the engine body and at least another induction air passage being positioned along the second outer side of the engine body, each of said induction air passages communicating with the throttle body, wherein the throttle body is disposed above the induction air support member.

23. The engine of claim 22, wherein the induction air support member provides fluid communication between the induction air passages and the air silencer.

24. The engine of claim 23, wherein the engine includes a throttle valve housing positioned between and in fluid communication with both the air silencer and the induction air support member.

25. The engine of claim 21, wherein the throttle valve housing is mounted to and supported by the induction air support member.

26. The engine of claim 22, wherein the air intake system further comprises a plurality of plenum chambers, at least one plenum chamber being disposed between each induction air passage and the induction air support member.

27. Then engine of claim 26, wherein the induction air support member supports each of the plenum chambers.

28. An engine for an outboard motor wherein the engine is positioned within an engine cowling, the engine comprising an engine body supporting a crankshaft for rotation about a generally vertical axis, the engine body including a plurality of combustion chambers, at least one cylinder defining in part one of the combustion chambers, and an air intake system including an air silencer having an air intake port, a throttle body in communication with the air silencer, a plenum chamber housing defining a plenum chamber, the plenum chamber being positioned downstream of the throttle body, at least one induction air passage extending along a side of the engine body generally next to the at least one cylinder and being in communication with only one combustion chamber, and an induction air support member, the induction air support member connected to and providing fluid communication between the air silencer and the induction air passage, the induction air support member being attached to the engine body, the induction air support member being disposed below the throttle body and supporting the throttle body.

29. The engine of claim 28, wherein the air intake system comprises at least two runners positioned on opposite sides of the engine body from each other, each runner being in fluid communication with a corresponding combustion chamber and defining an induction air passage.

* * * * *

UNITED STATES PATENT AND TRADEMARK OFFICE

CERTIFICATE OF CORRECTION

PATENT NO. : 7,296,552 B2
APPLICATION NO. : 10/814412
DATED : November 20, 2007
INVENTOR(S) : Goichi Katayama It is certified that error appears in the above-identified patent and that said Letters Patent is hereby corrected as shown below:

Col. 11, line 13, claim 25, please delete "claim 21," and insert -- claim 24, --, therefor.

Signed and Sealed this

Fourteenth Day of October, 2008

JON W. DUDAS
*Director of the United States Patent and Trademark Office*